US005921873A

United States Patent [19]

Brown

[11] Patent Number: 5,921,873

[45] Date of Patent: Jul. 13, 1999

[54] SPORTS RACKET WITH ALTERNATIVELY POSITIONABLE STRINGS

[76] Inventor: Albert W. Brown, 1207 Pembroke, Newport Beach, Calif. 92660

[21] Appl. No.: 08/785,005

[22] Filed: Jan. 17, 1997

Related U.S. Application Data

[63] Continuation of application No. 08/519,455, Aug. 25, 1995, abandoned.

[51] Int. Cl.[6] ..... A63B 49/02

[52] U.S. Cl. ..... 473/540

[58] Field of Search ..... 473/523, 524, 473/533, 539, 540, 541, 542

[56] References Cited

U.S. PATENT DOCUMENTS

| | | | |
|---|---|---|---|
| 3,582,073 | 6/1971 | Melnick et al. | 473/541 |
| 3,751,034 | 8/1973 | Portz et al. | 473/523 |
| 3,968,966 | 7/1976 | D'Aquanni | 473/541 |
| 4,185,822 | 1/1980 | Li | 473/533 |
| 5,310,180 | 5/1994 | Wu | 473/541 |
| 5,312,115 | 5/1994 | Wu | 473/541 |

*Primary Examiner*—Raleigh W. Chiu
*Attorney, Agent, or Firm*—Roy A. Ekstrand

[57] ABSTRACT

A single piece molded sports racket includes a string frame defining an interior opening, a throat portion extending from the string frame and an integral grip/handle extending from the throat portion. The string frame further supports an integrally formed inwardly extending string flange having a plurality of apertures with corner radii extending there-through. The string frame may be strung from either side facilitating the positioning of the string plane of the racket at alternative offset positions with respect to the center plane of the string frame of the racket. Embodiments are shown which provide for alternative string plane positions either tangential to one edge of the string frame or offset therefrom. In alternate embodiments, the position of the string frame may be selected between alternatives of coplanar alignment with the center plane of the frame or offset or tangential to the frame edge.

19 Claims, 2 Drawing Sheets

SPORTS RACKET WITH ALTERNATIVELY POSITIONABLE STRINGS

CROSS-REFERENCE TO RELATED APPLICATIONS

This application is a continuation of copending application Ser. No. 08/519,455 filed Aug. 25, 1995 on behalf of the applicant of this application and which is entitled SPORTS RACKET WITH ALTERNATIVELY POSITIONABLE STRINGS now abandoned.

FIELD OF THE INVENTION

This invention relates generally to sports rackets and particularly to improvements therein which enlarge the usable striking area of the racket and simplifies the fabrication process.

BACKGROUND OF THE INVENTION

In a number of sports such as tennis, racquetball, squash, badminton, or the like, a type of sports racket is used which relies upon a strong rigid frame having a plurality of tensioned strings forming a net-like pattern across the frame center opening. An elongated handle extends from the frame to be gripped by the player. While the structures of such sports rackets vary substantially, several features are common to them all. For example, the strength of the frame and handle and balance of the racket is often critical to optimum performance in the particular sport in which it is used. In addition, substantial effort is devoted to maintaining appropriate tension within the string array to assure the desired resilience and impact characteristics of the racket.

It is a characteristic of such sports rackets that optimum striking power and energy application to the game object or ball is attained by impacting the racket within a relatively small portion of the string arrangement. Such portion is often referred to as the "sweet spot" of the racket. Thus, substantially less energy is imparted to the ball or game object outside the sweet spot. However, striking the ball or game object in such areas may nonetheless suffice in game play even though not optimum. Unfortunately, however, the presence of the supporting frame often limits the available hitting area of the string arrangement due to the radius of curvature or size of the object being struck. In particular, game or ball objects being struck partially by the outer frame at the extremes of the string arrangement results in poor play and unpredictable rebound direction and, as a result, low control capability by the player. While all such sports activities using such sports rackets suffer from this problem in some degree, tennis is probably the most critical due to the larger ball used. The greater diameter of the tennis ball requires that the ball must be struck a substantial distance in from the outer frame to avoid impact between the ball and frame.

Recognizing the problems such as those described above inherent in the design and fabrication of such sports rackets, practitioners in the art have provided a virtually endless variety of sports rackets designs. Some sport racket designs have provided rackets which are in essence "two-sided" having dual string arrays on each outer edge of the racket frame. Others have provided various improvements in frame design and materials while still others have endeavored to improve string arrangement and tensioning. For example, U.S. Pat. No. 5,197,731 issued to Svoma, et al. sets forth a STRING SUSPENSION AND FRAME CONSTRUCTION FOR SPORTS RACKETS having a stringed playing surface wherein selected ends of individual string segments meet the frame alternately in front or behind the plane of the playing surface.

U.S. Pat. No. 5,184,818 issued to Lo sets forth a METAL RACKET having a hollow looped head portion defining a cross-section lying on a plane perpendicular to a string web held by the looped head portion. The cross-section includes a convex outer periphery with two terminating ends disposed on opposite sides of the stringed web.

U.S. Pat. No. 5,172,911 issued to Chang sets forth a METAL RACKET FRAME having a metal tube which is bent so as to form a curved head portion. The racket frame further includes a converging throat portion which extends from the head portion together with a handle portion which extends from the throat portion. The metal tube is provided with a pair of spaced elongated partitions which extend along the length of the metal tube. The partitions confine a central space therebetween and a side space on each side of the center space.

U.S. Pat. No. 4,561,655 issued to Mortvedt sets forth a TUBULAR STEEL RACKET FRAME HAVING VARYING CROSS-SECTION which provides strength in the lower racket portion to reduce the torsional and flexing movements of the frame in the area of the lower portion.

U.S. Pat. No. 4,279,418 issued to Lacoste sets forth RACKETS FOR TENNIS AND OTHER GAMES having a oval or pear-shaped stringing surface on an auxiliary element for maintaining the strings in a median plane at determined places in which at least some strings are wound simultaneously around the frame and around the auxiliary element.

U.S. Pat. No. 4,204,690 issued to Blackburne sets forth RACKETS having double stringing disposed in two generally parallel planes located on the opposite edges of the head frame.

U.S. Pat. No. 4,141,549 issued to Hayes, et al. sets forth a TENNIS RACKET having a frame member forming a head portion having duplicate strung ball striking matrices. Each matrix is substantially coplanar with a respective front and rear face of the frame member.

U.S. Pat. No. 4,049,269 issued to Blackburne sets forth RACKETS including a handle intended to be held in the hand and carrying a head having an open marginal frame defining a central opening across which extends tension stringing carried by the head frame. Instead of being located in a single plane disposed centrally of the bounded head frame, the stringing of the racket is disposed in two generally parallel planes located on opposite sides of the frame.

U.S. Pat. No. 3,968,966 issued to D'Aquanni sets forth a RACKET WITH TWO INDEPENDENTLY STRUNG FACES in which a racket frame supports two string matrices parallel to each outer edge of the racket frame.

U.S. Pat. No. 3,904,202 issued to DeLorean sets forth a RACKET including a string tensioning system symmetrically disposed about the racket frame so as to impose substantially equal spring tension forces throughout the length of the frame.

U.S. Pat. No. 3,899,172 issued to Vaughn, et al. sets forth a TENNIS RACKET HAVING IMPROVED STRENGTH FACTOR utilizing a novel frame strip, plastic throat piece structure, grommet means and handle structure to provide an improved racket having improved strength characteristics as well as reliability and durability.

U.S. Pat. No. 3,752,478 issued to Flak sets forth a RACKET FRAME formed of extruded aluminum provided with a tri-hollow cross-section enabling the frame to be reduced in weight without detracting from the strength of the frame.

U.S. Pat. No. 1,502,845 issued to Blache sets forth a RACKET having plural grooves in the outer racket frame which receive and guide the racket strings.

French Patent 1,212,195 sets forth a sports racket having a generally rectangular cross-section frame defining outer surface grooves which receive and guide racket strings.

British Patent 2,007,985 sets forth a sports racket having tensioned strings wound thereon. The frame includes an inwardly projecting rigid lip contacting one side of the strings and operative to change the effective length of the string depending upon the direction from which the string array is struck.

French Patent 855,902 sets forth a resiliently strung sports racket having helically wound string patterns.

British Patent 409,924 sets forth an improved sports racket having a frame defining a plurality of apertures therethrough which receive the tensioned string and secure it to the frame.

While the foregoing described prior art devices have in some instances enjoyed commercial success and have to some extent improved the art generally, there remains nonetheless a continuing need in the art for a sports racket which more effectively addresses the above-described problems while remaining relatively simple in construction.

SUMMARY OF THE INVENTION

Accordingly, it is a general object of the present invention to provide an improved sports racket. It is a more particular object of the present invention to provide an improved sports racket having alternatively positionable strings to alternatively position the string plane with respect to the racket frame. In addition, it is an object of this invention to provide a simple, single piece sports racket of molded material that includes the string frame, throat and a predetermined integral grip size as molded.

In accordance with the present invention, there is provided a sports racket comprising: a frame defining a string frame portion forming an interior opening, a grip/handle and a throat portion extending between the string frame portion and the integral grip/handle; a string flange formed on the string frame portion and extending inwardly of the string frame portion into the interior opening, the string flange defining opposed faces and a plurality of string apertures; and a plurality of string segments passing through the string apertures such that string segments spanning the interior opening extend from a common one of the opposed faces to define a string plane, the string plane being alternatively positioned with respect to the string frame portion by selecting either of the opposed faces for the string segments spanning the interior opening.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
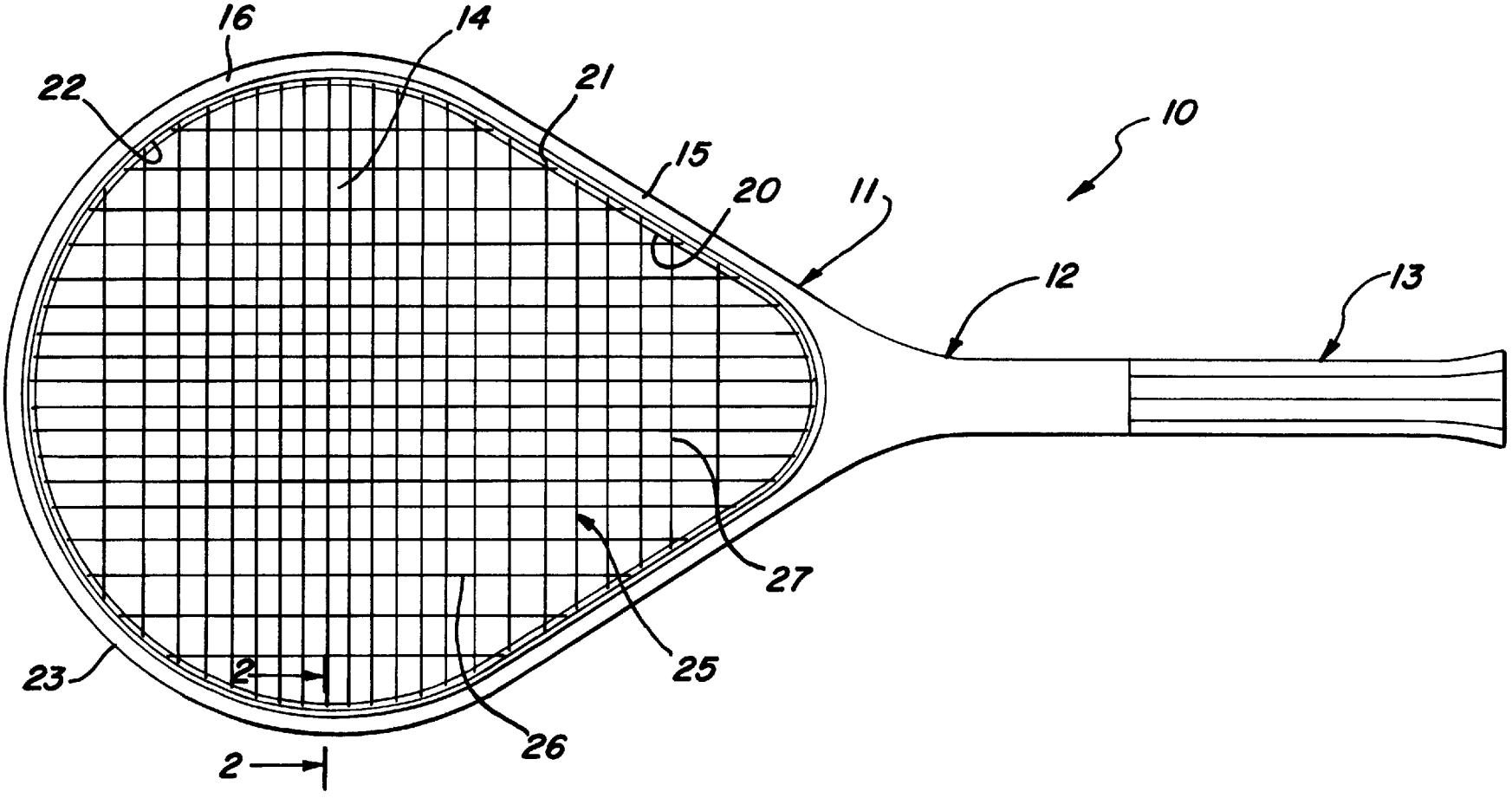
FIG. 1 sets forth a planar view of a sports racket constructed in accordance with the present invention.

FIG. 1 sets forth a top plan view of a sports racket constructed in accordance with the present invention and generally referenced by numeral 10. Racket 10 is configured for the game of tennis. However, it will be apparent to those skilled in the art that the construction of racket 10 set forth in FIGS. 1 through 4 herein applies equally well to other sports which utilize a strung racket and frame combination. Racket 10 includes a frame 11 defining a string frame 15 which in turn defines an interior opening 14. String frame 15 also defines an upper edge 16 and a lower edge 17 (the latter seen in FIGS. 2A and 2B). Frame 11 further includes a throat portion 12 tapering to an elongated integral grip/handle 13. In its preferred form, frame 11 is formed of a high strength lightweight material such as molded composite material or the like. In accordance with an important aspect of the present invention, string frame 15 defines an inwardly extending integrally formed string flange 20. String flange 20 is shown in greater detail in FIGS. 2A and 2B. However, suffice it to note here that string flange 20 extends inwardly from interior wall 22 of string frame 15. String flange 20 extends about the entire interior surface of interior wall 22 of string frame 15 surrounding opening 14. String flange 20 further defines a plurality of string apertures 21 which as is set forth below in greater detail facilitate the lacing or stringing of the racket strings to provide a net-like string plane 25. String plane 25 is formed of a plurality of axial string segments 26 extending in generally parallel relationship to the axis of handle 13 in what is in essence a top to bottom direction. Conversely, transverse string segments 25 extend from side to side and are generally perpendicular to axial string segments 26. In accordance with conventional fabrication techniques, axial string segments 26 and transverse string segments 27 are alternately interleaved to form a compact high tension string plane. Although not shown on the drawing, the string apertures may, in accordance with conventional techniques, be positioned to yield a diamond-like string pattern.

Figure 2A:
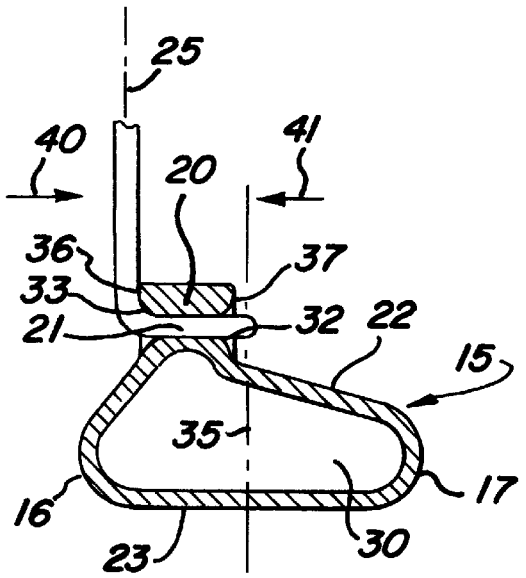
FIGS. 2A and 2B sets forth section views of the present invention sports racket taken along section lines 2—2 in FIG. 1 having alternative string plane positions.

In accordance with an important aspect of the present invention set forth below in greater detail, string flange 20 is positioned upon interior wall 22 of string frame 15 such that the relative position of string plane 25 within frame 15 may be chosen based upon the direction in which the string segments are strung upon flange 20. Thus, in accordance with an important aspect of the present invention, the fabricator is able to provide rackets having different string plane locations with respect to upper edge 16 and lower edge 17 of frame 11. For example, in the preferred form of the present invention set forth below in FIGS. 2A and 2B, the relative position of string plane 25 with respect to upper edge 16 and lower edge 17 may be selected between an offset position such as shown in FIG. 2A or a center-line position shown in FIG. 2B. Additionally, FIGS. 3 and 4 set forth further alternate embodiments of the present invention in which the positions available for string plane 25 are positioned in different manners with respect to upper edge 16 and lower edge 17 of frame 11. It has been found advantageous to provide certain players with an offset string plane position in order to better ensure that the above-described problem of frame to ball impact under intense playing conditions is more likely to be avoided. In further accordance with an important aspect of the present invention, the structure of string flange 20 and string frame 15 ensures that in either alternate frame stringing and string frame position, the overall hitting characteristic from each side of string plane 25 is substantially the same. Thus, a player utilizing racket 10 is able to employ forehand and backhand strokes with equal confidence and strength and is able to realize maximum impact from either side.

Figure 2B:
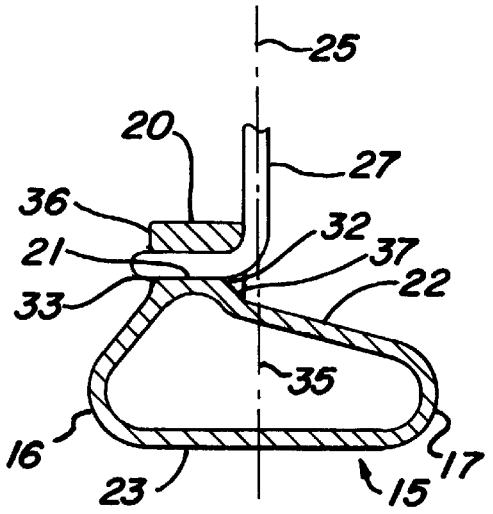

FIGS. 2A and 2B set forth section views of the present invention sports racket taken along section lines 2—2 in FIG. 1. By way of overview, FIG. 2A sets forth a section view of racket 10 with string frame 25 positioned offset from the center plane of frame 15 toward upper edge 16. Conversely, FIG. 2B sets forth a section view of racket 10 showing the alternate stringing of racket 10 which places string plane 25 within the center plane of string frame 15. It should be noted that the alternate position of string plane 25 is obtained by stringing racket 10 in opposite directions through string flange 20.

More specifically, FIG. 2A sets forth a section view of racket 10 taken along section lines 2—2 in FIG. 1. Racket 10 includes a string frame 15 formed of a hollow member defining an interior cavity 30 and a center plane 35. String frame 15 further defines an upper edge 16 and a lower edge 17 together with an interior wall 22 and an outer wall 23. In the preferred fabrication of the present invention, edges 16 and 17 are rounded as shown in FIGS. 2A and 2B. Interior wall 22 tapers inwardly and supports an integrally formed string flange. String flange 20 defines a plurality of string apertures 21 which receive a string segment 27. String flange 20 defines opposed generally parallel faces 36 and 37 through which string apertures 21 extend. In the preferred fabrication of the present invention, string apertures 21 each define curved surfaces 32 and 33 providing radii of curvature for string segments passing through string aperture 21.

In the configuration set forth in FIG. 2A, the position of string plane 25 within which string segment 27 lies is offset from center plane 35 of string frame 15. This offset of string plane 25 is achieved by placing each string segment through apertures 21 of string flange 20 in the manner shown for string segment 27. Thus, the plurality of string segments which make up string plane 25 (seen in FIG. 1) are formed by string segments which extend inwardly from string flange 20 along face 36 of flange 20. The opposite face 37 of string flange 20 is limited to supporting the interconnecting portions of string segments which extend between apertures 21 rather than spanning opening 14 (seen in FIG. 1). As a result, all string segments forming string plane 25 are positioned with respect to flange 20 in the manner shown for string segment 27. This positions string plane 25 offset from center plane 35 of frame 15 to provide the above-described benefits in minimizing the likelihood of frame to ball impact where the ball meets string plane 25 traveling in the direction indicated by arrow 40. Conversely, a ball traveling in the impact direction indicated by arrow 41 must be spaced substantially inwardly from frame 15 to avoid contact with the frame.

Thus, the configuration shown in FIG. 2A offsets the string plane with respect to the center plane of the racket frame. This arrangement provides the advantage of giving the player a racket side which is suitable for use in situations such as playing the net or doubles tennis often subject to errors of misstriking a ball by impacting the frame portion. It has been found that players quickly adjust to this advantageous circumstance and are able to easily orient the racket to place the offset side of the racket toward the opposing players when playing in these situations.

FIG. 2B sets forth a section view of racket 10 taken along section lines 2—2 in FIG. 1 in which the racket stringing has been reversed with respect to string flange 20 to position the resulting string plane in a coplanar alignment with center plane 35 of frame 15. Thus, as set forth above, string frame 15 defines a hollow frame having an interior 30, an upper edge 16, a lower edge 17, an outer wall 23 and an interior wall 22. Interior wall 22 further supports an integrally formed inwardly extending string flange 20 having a plurality of string apertures such as string aperture 21 formed therethrough. Flange 20 further defines a face 36 and an opposed face 37. Each of apertures 21 define curved transitional portions extending inwardly from faces 36 and 37 forming radii 32 and 33.

Flange 20 is fabricated such that face 37 is positioned with respect to center plane 35 of frame 15 such that face 37 is distanced from center plane 35 by approximately one-half the diameter of string segment 27. Accordingly, with string segment 27 passed through aperture 21 in the manner shown in FIG. 2B and drawn outwardly from flange 21 along face 37 overlying radius 32, string segment 27 is generally centered with respect to center plane 35. The opposed end of string segment 27 passes across face 36 of flange 20 to the adjoining string aperture and extends therethrough. As a result, all string segments such as string segment 27 extend across opening 14 of frame 11 (seen in FIG. 1) in the manner shown for string segment 27. As a result, string plane 25 is positioned in substantially coplanar alignment with center plane 35 of frame 15.

Comparison of FIGS. 2A and 2B shows that the use of a single frame 15 having an inwardly extending string flange 20 provides the opportunity to string racket 10 such that string plane 25 is either offset from the center plane of the racket frame or substantially aligned with the racket center plane. It will be apparent that in either event, the hitting characteristics of the resulting racket remain substantially uniform in each direction due to the structure of string frame 20. Thus, a player is able, for example, to utilize the present invention racket in the stringing configuration shown in FIG. 2B and when desired have the racket restrung to the offset configuration shown in FIG. 2A or vice versa. The important aspect is the provision of alternative string plane locations by simply stringing the racket in opposite directions through string flange 20.

Figure 3:
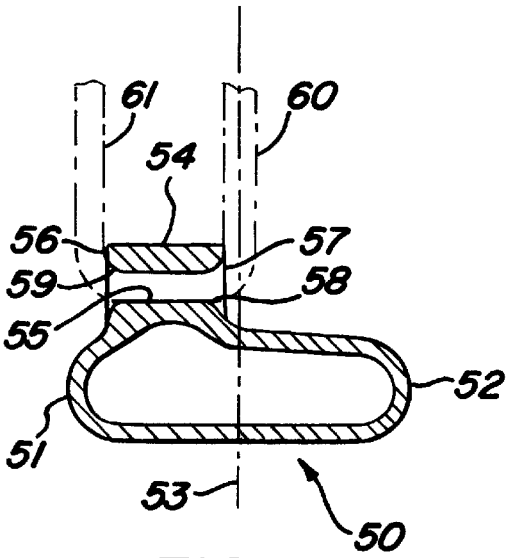
FIG. 3 sets forth a section view of an alternate embodiment of the present invention sports racket.

FIG. 3 sets forth a section view of an alternate embodiment of the present invention in which the string plane may be located either in a substantially tangential relationship to the frame edge or in a substantially center position within the frame. More specifically, FIG. 3 sets forth a string frame 50 which is substantially identical to frame 11 and string frame 15 set forth above in FIG. 1 with the difference being the use of an inwardly extending string flange 54 of substantially greater width than string flange 20 shown in FIGS. 1, 2A and 2B. The purpose of a wider string flange is to provide alternative string plane positions either substantially tangential to the edge of the string frame or substantially aligned with the center plane of the string frame. Thus, string frame 50 defines an upper edge 51, a lower edge 52 and a center plane 53. A string flange 54 integrally formed with string frame 50 extends inwardly and defines a plurality of string apertures such as string aperture 55. String flange 20 defines a pair of opposed faces 56 and 57. Face 56 is positioned with respect to edge 51 by a distance approximately equal to the diameter of a string segment 61. Thus, with a string segment 61 shown in dashed-line representation extending inwardly from flange 54 upon face 56, the resulting string plane is positioned substantially tangential to edge 51 and is fully offset within string frame 50. Conversely, face 57 is positioned with respect to center plane 53 by a distance substantially equal to one-half the diameter of a string segment. Accordingly, with string segments such as string segment 60 shown in dashed-line representation passing through string flange 54 and extending inwardly upon face 57 thereof, the string plane of the racket is substantially coaligned in a coplanar relationship with center plane 53. Thus, it will be apparent from examination of FIG. 3 that the larger string flange of the embodiment of FIG. 3 facilitates a maximum of choice in alternative positioning of the string plane by simply selecting the direction of racket stringing within the string flange.

Figure 4:
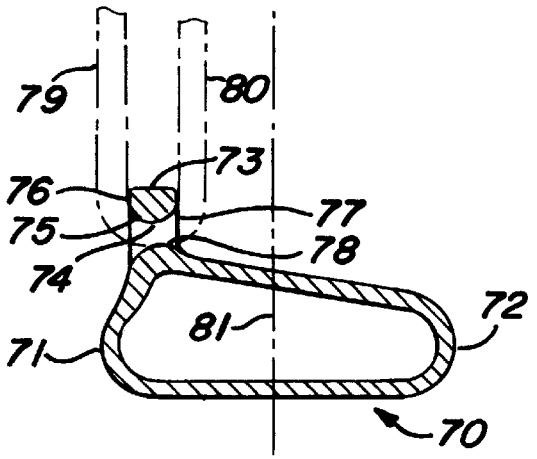
FIG. 4 sets forth a section view of a still further alternate embodiment of the present invention sports racket.

FIG. 4 sets forth a section view taken along section lines 2—2 in FIG. 1 of a still further alternate embodiment of the present invention sports racket having a string frame 70 configured substantially in accordance with frame 11 and string frame 15 set forth for racket 10 in FIG. 1. The difference between string frame 70 and string frame 15 of the embodiment of FIG. 1 is the thickness and position of string flange 73. Thus, string frame 70 defines an upper edge 71, a lower edge 72 and an inwardly extending string flange 73 having opposed faces 76 and 77. String flange 73 defines a plurality of string apertures such as string aperture 74 each having curved transition surfaces shown as radii 75 and 78. String frame 70 defines a center plane 81 equidistant between edges 71 and 72. String flange 73 is substantially thinner than the above-described embodiments and thus provides a face 76 spaced from edge 71 so as to position a string segment shown in dashed-line representation 79 in a substantially tangential relationship with edge 71. The thinner structure of string flange 73 facilitates the stringing of string segments such as string segment 80 shown in dashed-line representation on face 77 which is substantially offset from center plane 81. Thus, the embodiment shown in FIG. 4 as string frame 70 facilitates alternative string plane positions indicated by alternate string segment extensions 79 or 80 to provide either a tangential string plane or an offset string plane at the user's choice.

Figure 5:
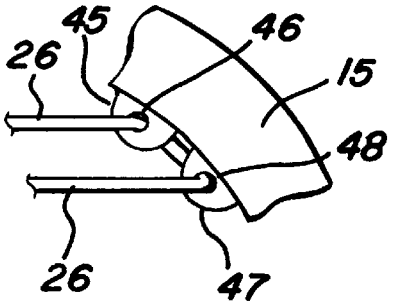
FIG. 5 sets forth a scrap view of a still further alternate embodiment of the present invention sports racket.

FIG. 5 sets forth a scrap view of a further alternate embodiment of the present invention in which a plurality of string flange portions such as portions 45 and 47 replace string flange 20 (seen in FIG. 1). The flange portions each define apertures such as apertures 46 and 48 for receiving string segments 26.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A sports racket consisting of:

a frame defining a string frame portion forming an interior opening, a handle and a throat portion extending between the string frame portion and the handle;

a single string flange integrally formed with said string frame portion and extending inwardly of said string frame portion into said interior opening, said string flange defining opposed faces both offset to the same side of said frame center plane and a plurality of string apertures; and a plurality of string segments passing through said string apertures such that string segments spanning said interior opening extend from a common one of said opposed faces to define a string plane, said string frame portion defining first and second edges and a center plane and wherein said string segments define a string diameter and wherein one of said opposed faces of said string flange is positioned substantially one string diameter from said first edge;

said string plane being alternatively positioned with respect to said string frame portion by selecting either of said opposed faces for said string segments spanning said interior opening.

2. A sports racket as set forth in claim 1 wherein the remaining one of said opposed faces is positioned substantially one half of one string diameter from said center plane.

3. A sports racket as set forth in claim 2 wherein the remaining one of said opposed faces is positioned substantially one half of one string diameter from said center plane.

4. A sports racket as set forth in claim 1 wherein the remaining one of said opposed faces is positioned from said center plane in an offset greater than one string diameter.

5. A sports racket as set forth in claim 1 wherein said string frame portion defines first and second edges and a center plane and wherein said string segments define a string diameter and wherein one of said opposed faces of said string flange is positioned between said center plane and said first edge.

6. A sports racket as set forth in claim 5 wherein the remaining one of said opposed faces is positioned from said center plane in an offset greater than one string diameter.

7. A sports racket as set forth in claim 5 wherein each of said string apertures define curved radii extending from said opposed faces.

8. A sports racket as set forth in claim 1 wherein each of said string apertures define curved radii extending from said opposed faces.

9. A sports racket consisting of:

a frame defining a string frame portion forming an interior opening, a handle, a throat portion extending between said string frame portion and said handle, a single string flange integrally formed on said string frame, extending inwardly of said string frame portion, offset from a center plane of said string frame portion and defining a plurality of apertures, and a single string plane substantially tangent to one edge of said frame.

10. A sports racket as set forth in claim 9 wherein each of said string apertures define curved radii extending from said opposed faces.

11. A sports racket as set forth in claim 10 wherein said string flange includes a plurality of inwardly extending spaced apart flange segments each defining at least one string aperture therein.

12. A sports racket consisting of:

a frame defining a string frame portion forming an interior opening, a handle and a throat portion extending from the string frame portion and said handle;

a single string flange integrally formed on said string frame portion and extending inwardly of said string frame portion into said interior opening, said string flange defining opposed faces and a plurality of string apertures wherein said string frame portion defines first and second edges and a center plane; and a plurality of string segments passing through said string apertures such that string segments spanning said interior opening extend from a common one of said opposed faces to define a string plane, said string segments defining a string diameter and one of said opposed faces of said string flange being positioned substantially one string diameter from said first edge, said string plane being alternatively positioned with respect to said string frame portion by selecting either of said opposed faces for said string segments spanning said interior opening.

13. A sports racket as set forth in claim 12 wherein the remaining one of said opposed faces is positioned substantially one half of one string diameter from said center plane.

14. A sports racket as set forth in claim 12 wherein the remaining one of said opposed faces is positioned from said center plane in an offset greater than one string diameter.

15. A sports racket as set forth in claim 12 wherein each of said string apertures define curved radii extending from said opposed faces.

16. A sports racket consisting of:

a frame defining a string frame portion forming an interior opening, a handle and a throat portion extending between said string frame portion and said handle;

a single string flange integrally formed on said string frame portion and extending inwardly of said string frame portion into said interior opening, said string flange defining opposed faces and a plurality of string apertures wherein said string frame portion defines first and second edges and a center plane; and a plurality of string segments passing through said string apertures such that string segments spanning said interior opening extend from a common one of said opposed faces to define a string plane, said string segments defining a string diameter and one of said opposed faces of said string flange being positioned between said center plane and said first edge, said string plane being alternatively positioned with respect to said string frame portion by selecting either of said opposed faces for said string segments spanning said interior opening.

17. A sports racket as set forth in claim 16 wherein the remaining one of said opposed faces is positioned substantially one half of one string diameter from said center plane.

18. A sports racket as set forth in claim 16 wherein the remaining one of said opposed faces is positioned from said center plane in an offset greater than one string diameter.

19. A sports racket as set forth in claim 16 wherein each of said string apertures define curved radii extending from said opposed faces.

* * * * *